US011717017B2

(12) United States Patent
Hassler et al.

(10) Patent No.: US 11,717,017 B2
(45) Date of Patent: Aug. 8, 2023

(54) FLAVOURED MOIST ORAL POUCHED NICOTINE PRODUCT COMPRISING TRIGLYCERIDE

(71) Applicant: Swedish Match North Europe AB, Stockholm (SE)

(72) Inventors: Thord Hassler, Helsingborg (SE); Mårten Kindvall, Gothenburg (SE); Lars Jonsson, Floda (SE); Jenny Kannisto, Hisings Backa (SE)

(73) Assignee: SWEDISH MATCH NORTH EUROPE AB, Stockholm (SE)

( * ) Notice: Subject to any disclaimer, the term of this patent is extended or adjusted under 35 U.S.C. 154(b) by 256 days.

(21) Appl. No.: 16/605,640

(22) PCT Filed: Apr. 24, 2018

(86) PCT No.: PCT/EP2018/060419
§ 371 (c)(1),
(2) Date: Oct. 16, 2019

(87) PCT Pub. No.: WO2018/197454
PCT Pub. Date: Nov. 1, 2018

(65) Prior Publication Data

US 2020/0128870 A1 Apr. 30, 2020

(30) Foreign Application Priority Data

Apr. 24, 2017 (NO) ..... 20170683
Apr. 24, 2017 (SE) ..... 1750488-7

(51) Int. Cl.
*A24B 13/00* (2006.01)
*A24B 15/16* (2020.01)
*A24B 15/42* (2006.01)

(52) U.S. Cl.
CPC ..... *A24B 13/00* (2013.01); *A24B 15/16* (2013.01); *A24B 15/42* (2013.01)

(58) Field of Classification Search
None
See application file for complete search history.

(56) References Cited

U.S. PATENT DOCUMENTS

2008/0286341 A1 11/2008 Andersson et al.
2010/0218779 A1 9/2010 Zhuang et al.
(Continued)

FOREIGN PATENT DOCUMENTS

EP 2888951 A1 7/2015
EP 3087852 A1 11/2016
(Continued)

OTHER PUBLICATIONS

Federal Register/vol. 74, No. 4/712-719/Wednesday, Jan. 7, 2009/ Notices "Total moisture determination" and AOAC (Association of Official Analytical Chernies), Official Methods of Analysis 966.02: "Moisture in Tobacco" (1990), Fifth Edition, K. Helrich (ed).
(Continued)

*Primary Examiner* — Dennis R Cordray
(74) *Attorney, Agent, or Firm* — Knobbe Martens Olson & Bear LLP

(57) ABSTRACT

The present disclosure relates to an oral pouched nicotine product comprising a moist filling material and a saliva-permeable pouch of a packaging material enclosing the moist filling material, wherein the moist filling material comprises a particulate non-tobacco material, such as micro-crystalline cellulose, a flavouring agent, a nicotine source, a pH adjusting agent, and within the range of from about 0.5 to about 20% by weight, based on total weight of the filling material, of triglyceride. The moist filling material may further comprise a tobacco material within the range of from
(Continued)

about 0 wt % to about 10 wt % based on the total weight of the moist filling material.

18 Claims, 4 Drawing Sheets

(56) References Cited

U.S. PATENT DOCUMENTS

| | | | | |
|---|---|---|---|---|
| 2010/0282267 | A1 | 11/2010 | Atchley | |
| 2011/0104218 | A1 | 5/2011 | Karles et al. | |
| 2012/0031414 | A1 | 2/2012 | Atchley et al. | |
| 2012/0011831 | A1 | 5/2012 | Cantrell et al. | |
| 2012/0298124 | A1* | 11/2012 | Shikata | A24B 13/00 131/352 |
| 2013/0160782 | A1 | 6/2013 | Axelsson et al. | |
| 2013/0236605 | A1 | 9/2013 | Crawford et al. | |
| 2013/0340774 | A1 | 12/2013 | Mishra et al. | |
| 2013/0340776 | A1 | 12/2013 | Mishra et al. | |
| 2014/0130813 | A1 | 5/2014 | Strehle | |
| 2014/0271946 | A1 | 9/2014 | Kobal et al. | |
| 2015/0020818 | A1 | 1/2015 | Gao et al. | |
| 2015/0034099 | A1 | 2/2015 | Besso | |
| 2015/0068545 | A1* | 3/2015 | Moldoveanu | A24B 13/00 131/352 |
| 2015/0257436 | A1 | 9/2015 | Essen et al. | |
| 2016/0000140 | A1* | 1/2016 | Sebastian | B65B 9/20 53/450 |
| 2016/0165953 | A1* | 6/2016 | Goode, Jr. | A24B 13/00 131/352 |
| 2016/0303106 | A1 | 10/2016 | Gao et al. | |
| 2017/0157106 | A1* | 6/2017 | Rogers | A24D 1/025 |

FOREIGN PATENT DOCUMENTS

| | | | |
|---|---|---|---|
| RU | 2476221 | C2 | 2/2013 |
| RU | 2544147 | C2 | 3/2015 |
| RU | 2562784 | C2 | 9/2015 |
| WO | WO 2004/056363 | A2 | 7/2004 |
| WO | WO 2007/104573 | A2 | 9/2007 |
| WO | WO 2008/133563 | A1 | 11/2008 |
| WO | WO 2009/056609 | A1 | 5/2009 |
| WO | WO 2010/114445 | A1 | 10/2010 |
| WO | WO 2011/116977 | A1 | 9/2011 |
| WO | WO 2012/069505 | A1 | 5/2012 |
| WO | WO 2012/134380 | A1 | 10/2012 |
| WO | WO 2013/109961 | A1 | 7/2013 |
| WO | WO 2014/150881 | A1 | 9/2014 |
| WO | WO 2015/009913 | A1 | 1/2015 |
| WO | WO 2015/057603 | A1 | 4/2015 |
| WO | WO 2016/097294 | A1 | 6/2016 |

OTHER PUBLICATIONS

International Search Report for PCT/EP2018/060419 dated Jul. 12, 2018.

* cited by examiner

FLAVOURED MOIST ORAL POUCHED NICOTINE PRODUCT COMPRISING TRIGLYCERIDE

CROSS REFERENCE TO RELATED APPLICATIONS

This application is a U.S. National Phase Application of PCT International Application Number PCT/EP2018/060419, filed on Apr. 24, 2018, designating the United States of America and published in the English language, which is an International Application of and claims the benefit of priority to Norwegian Patent Application No. 20170683, filed on Apr. 24, 2017, and Swedish Application No. 1750488-7, filed on Apr. 24, 2017. The disclosures of the above-referenced applications are hereby expressly incorporated by reference in their entireties.

TECHNICAL FIELD

The present disclosure relates to an oral pouched nicotine product comprising a moist filling material including a particulate non-tobacco material, such as microcrystalline cellulose, a flavouring agent, a nicotine source and a pH adjusting agent.

BACKGROUND

Moist snuff for oral use is available in loose form or portion-packed in a saliva-permeable, porous wrapper material forming a pouch. Pouched moist snuff is typically used by the user by placing the pouch between the upper or lower gum and the lip or cheek and retaining it there for a limited period of time. The pouch material holds the tobacco in place while allowing saliva to pass into the interior of the pouched product and allowing flavors and nicotine to diffuse from the tobacco material into the user's mouth.

There are oral pouched nicotine-containing non-tobacco products available which may be offered as alternatives to oral pouched smokeless tobacco products. These oral pouched non-tobacco nicotine products are generally used in the same manner as the corresponding oral pouched tobacco-containing products and are herein referred to as oral pouched nicotine products.

Oral pouched smokeless tobacco products as well as oral pouched non-tobacco nicotine products may be produced by measuring portions of the filling material and inserting the portions into a packaging material. The packaging material forming the pouch in oral pouched products is typically a dry-laid bonded nonwoven comprising viscose rayon fibres (i.e. regenerated cellulose) and an acrylic polymer that acts as binder in the nonwoven material and provides for heat-sealing of the pouches during manufacturing thereof. The packaging material forming the pouch of the oral pouched product should during manufacturing of the pouch provide for sealing, upon storage of the pouch exhibit none or a low degree of discoloration and upon usage by a consumer preserve integrity and strength, allow for a desired release profile of nicotine and flavors and provide a pleasant mouthfeel.

The organoleptic properties, such as texture, aroma, taste, shape and appearance, of the pouched product are of high importance to the user. It is generally desirable to provide oral pouched nicotine products with rapid release of flavor and nicotine to provide an initial strong flavor experience and/or reduce nicotine craving.

WO 2004/056363 A2 relates to a nicotine-containing particulate material comprising a combination of nicotine or a pharmaceutically acceptable salt, complex or solvate thereof and a microcrystalline cellulose. WO 2007/104573 A2 relates to the use of a nicotine-cellulose combination for the preparation of a snuff composition. The nicotine-cellulose combination may be enclosed in a membrane material.

WO 2010/114445 A1 relates to a plant fiber product for oral use containing a mixture of plant fibers, such as tea, coffee, tobacco, cocoa, maize, herbs, yerba mate or cellulose, and an alginate composition dispersed in the product and comprising water, alginate and an added substance intended to be released from the product when said product is used. The added substance may be an active substance, such as nicotine, or a taste substance.

WO 2012/134380 A1 relates to a product for oral delivery of nicotine containing a core comprising a powder of at least one free nicotine salt, at least one pH adjusting agent and at least one filler, and a water insoluble pouch enclosing the powder. As disclosed in WO 2012/134380 A1, many nicotine salts are known to be physically and chemically stable. By using a suitable nicotine salt, instead of nicotine base, the problems with the oxidation and the volatility can be reduced or avoided. By using a nicotine salt it is not necessary to form a combination between the nicotine and other components in the powder to protect the nicotine from oxidation and high volatility. The nicotine salt can be free, i.e. it only needs to be mixed together with the other components in the powder. Moreover, the at least one pH adjusting agent ensures that when the powder is dissolved in saliva, a sufficiently high local pH is obtained. Such a high local pH is important to ensure that the dissolved nicotine is unprotonated and hence can be effectively absorbed through the oral mucosa.

WO 2015/009913 A1 relates to a method for incorporating liquid nicotine into an oral product, comprising (a) mixing liquid nicotine with cellulosic fiber to produce a cellulosic fiber-nicotine mixture; (b) mixing the cellulosic fiber-nicotine mixture with one or more binders to form an oral product pre-molding mixture; and (c) molding the oral product pre-molding mixture into an oral product.

US 2013/0160782 discloses the use of a nicotine-cellulose combination for the preparation of a snuff composition for achievement of a fast onset of action of nicotine after application of the snuff composition to the oral cavity of a subject. It is mentioned that the snuff composition may comprise flavouring agents.

US 2010/0282267 discloses an encapsulated flavorant or artificial sweetener for use with smokeless tobacco and related products. The encapsulated flavourant or sweetener comprises a core encapsulated with a lipid-based coating which provides stability when in contact with tobacco, yet releases flavour over time when the product is used. The lipid coating may be a monoglyceride or a triglyceride, or a combination thereof.

WO 2014/150881 discloses a nicotine-containing product that also contain anatabine. The product may further contain a flavourant, a filler and a plasticizer. The plasticizer may be vegetable oil or medium chain triglycerides.

EP3087852 discloses an oral pouched product having a rectangular shape. The product may be a non-tobacco product. The filling material of the product may comprise nicotine or a salt thereof and a filler such as microcrystalline cellulose. Triglycerides are not mentioned.

Oral pouched nicotine-containing non-tobacco products are generally flavored. However, a significant amount of added flavor may be lost before the product is used due to, for instance, exposure to moisture, oxidation, and evaporation of the flavours. Generally, this problem is greater for moist oral pouched nicotine products than for dry oral pouched nicotine products.

Another problem associated with the incorporation of flavours in pouched products is that some flavours may have a negative impact on the seal strength of the resulting pouches which may lead to seal rupture upon storage of the products. In particular, impaired seal strength upon storage is a problem for moist oral pouched products.

SUMMARY OF THE INVENTION

An object of the present disclosure is to alleviate at least the problem discussed above, and to provide advantages and aspects not provided by hitherto known technique.

According to a first aspect of the present disclosure, there is provided an oral pouched nicotine product comprising a moist filling material and a saliva-permeable pouch of a packaging material enclosing the moist filling material, the moist filling material comprising a particulate non-tobacco material; a flavouring agent; a nicotine source; and a pH adjusting agent; wherein the moist filling material further comprises within the range of from about 0.5 to about 20% by weight, such as from about 0.5 to about 10% by weight, based on total weight of the filling material, of triglyceride. The oral pouched nicotine product may further comprise a tobacco material within the range of from about 0 wt % to about 10 wt %, based on the total weight of the moist filling material. Thus, there is provided an oral pouched nicotine product comprising a moist filling material and a saliva-permeable pouch of a packaging material enclosing the moist filling material, the moist filling material comprising a particulate non-tobacco material; a flavouring agent; a nicotine source; a pH adjusting agent; a tobacco material within the range of from about 0 wt % to about 10 wt %, based on the total weight of the moist filling material, and triglyceride within the range of from about 0.5 wt % to about 20 wt % such as from about 0.5 wt % to about 10 wt % based on the total weight of the moist filling material.

It has surprisingly been found that less flavour is lost during storage of the oral pouched product as disclosed herein in comparison to a similar pouched product comprising a moist filling material without triglyceride. Moreover, nicotine stability upon storage of the oral pouched nicotine product as disclosed herein is improved. Thus, the shelf life of the oral pouched nicotine product as disclosed herein is improved in comparison to an oral pouched nicotine product comprising a moist filling material without triglyceride.

It has also surprisingly been found that the seal strength upon storage of the oral pouched nicotine product as disclosed herein is improved in comparison to an oral pouched nicotine product comprising a moist filling material without triglyceride.

Moreover, the hardness of the oral pouched nicotine product as disclosed herein is reduced resulting in a more comfortable product.

Also, buccal irritation resulting from nicotine and the pH adjusting agent is reduced, in comparison to an oral pouched nicotine product comprising a moist filling material without triglyceride, when using the oral pouched nicotine product as disclosed herein.

According to a second aspect of the present disclosure, there is provided a method for manufacturing the oral pouched nicotine product disclosed herein, the method comprising:

providing a mixture of a particulate non-tobacco material and a nicotine source, such as a nicotine salt;

adding triglyceride, such as a vegetable fat or oil, to the mixture of particulate non-tobacco material and nicotine source, thereby providing a mixture of triglyceride, particulate non-tobacco material and nicotine source; and adding water to the mixture of triglyceride, particulate non-tobacco material and nicotine source wherein the pH adjusting agent is added in and/or after any of the foregoing steps and/or after the addition of water, a flavouring agent is added in and/or after any of the foregoing steps and/or after the addition of water, and optionally a tobacco material is added in and/or after any of the foregoing steps and/or after the addition of water.

DETAILED DESCRIPTION

Figure 1:
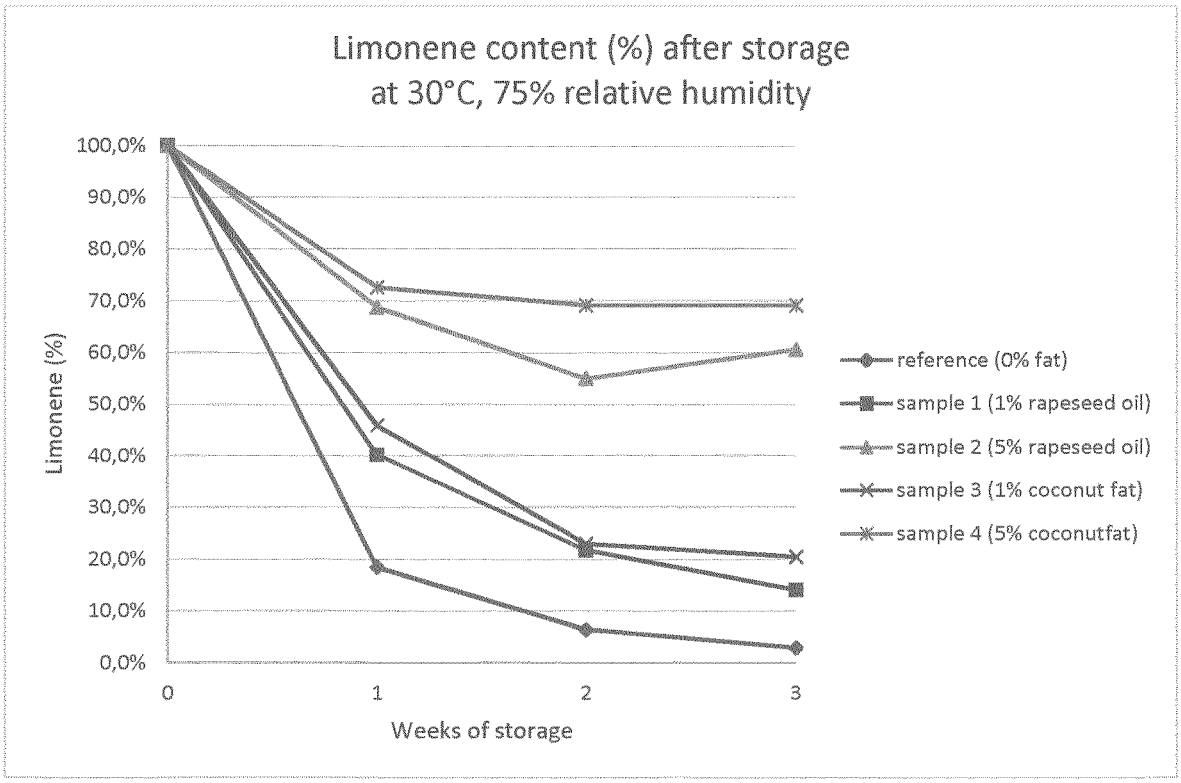
FIG. 1 illustrates limonene content (%) after storage at 30° C., 75% relative humidity, for a reference (0% fat), sample 1 (1% rapeseed oil), sample 2 (5% rapeseed oil), sample 3 (1% coconut fat), and sample 4 (5% coconut fat).

The term "tobacco material" is used herein for fibrous material of tobacco leaves or parts of leaves, such as lamina and stem. The leaves and parts of leaves may be finely divided (disintegrated), such as ground, cut, shredded or threshed, and the parts of leaves may be blended in defined proportions in the tobacco material.

By "tobacco" as used herein is meant any part, e.g., leaves, stems, and stalks, of any member of the genus *Nicotiana*. The tobacco may be whole, shredded, threshed, cut, ground, cured, aged, fermented, or treated otherwise, e.g., granulated or encapsulated.

"Oral" and "oral use" is in all contexts used herein as a description for use in the oral cavity of a human, such as buccal placement.

As used herein, the term "moisture content" refers to the total amount of oven volatile ingredients, such as water and other oven volatiles (e.g. propylene glycol) in the preparation, composition or product referred to. The moisture content is given herein as percent by weight (wt %) of the total weight of the preparation, composition or product referred to.

Some fibrous materials may exhibit hygroscopic properties. Hygroscopic materials maintain equilibrium moisture content depending on the ambient moisture and temperature.

The moisture content as referred to herein may be determined by using a method based on literature references Federal Register/ vol. 74, no. 4/712-719/Wednesday, Jan. 7, 2009/Notices "Total moisture determination" and AOAC (Association of Official Analytical Chemics), Official Methods of Analysis 966.02: "Moisture in Tobacco" (1990), Fifth Edition, K. Helrich (ed). In this method, the moisture content is determined gravimetrically by taking 2.5±0.25 g sample and weighing the sample at ambient conditions, herein defined as being at a temperature of 22° C. and a relative humidity of 60%, before evaporation of moisture and after completion of dehydration. Mettler Toledo's Moisture Analyzer HB43, a balance with halogen heating technology, is used (instead of an oven and a balance as in the mentioned literature references) in the experiments described herein. The sample is heated to 105° C. (instead of 99.5±0.5° C. as in the mentioned literature references). The measurement is stopped when the weight change is less than 1 mg during a 90 seconds time frame. The moisture content as weight percent of the sample is then calculated automatically by the Moisture Analyzer HB43.

"Flavour" or "flavouring agent" is used herein for a substance used to influence the aroma and/or taste of the nicotine product, including, but not limited to, essential oils, single flavour compounds, compounded flavourings, and extracts.

As used herein "% w/w" or "wt %" or "weight %" or "% by weight" refers to weight percent of the ingredient referred to of the total weight of the preparation, composition or product referred to.

As used herein, reference to "dry weight percent" "% by weight, based on dry weight" and the like refers to weight percent of the ingredient referred to on the basis of the total weight of dry ingredients, i.e. all ingredients of the preparation, composition or product referred to excluding moisture content.

As used herein, reference to "wet weight percent", "% by weight, based on wet weight" and the like refers to the weight percent of the ingredient referred to on the basis of the total weight of ingredients, i.e. all ingredients of the preparation, composition or product referred to including moisture content. Thus, "% by weight based on total weight" as used herein is the same as "% by weight based on wet weight".

As used herein the terms "pouched nicotine product for oral use" or "oral pouched nicotine product" refer to a portion of nicotine-containing filling material packed in a saliva-permeable pouch material intended for oral use.

As used herein, the term "triglyceride" refers to an ester derived from glycerol and three fatty acids, i.e. a tri-ester of glycerol and fatty acids. The triglyceride may be saturated or unsaturated.

As used herein, the term "particulate non-tobacco material" refers to a non-tobacco material comprising particles. The particles may have an average particle size within the range of from about 50 to about 500 μm. Further, the particles may be water insoluble or substantially water insoluble.

The oral pouched nicotine product as disclosed herein are intended for use in the oral cavity, such as buccal placement (e.g. by placing the pouched product between the upper or lower gum and the lip or cheek), and may therefore be referred to as portion-packed (pouched) product for oral use. The oral pouched product is sized and configured to fit comfortably and discreetly in a user's mouth between the upper or lower gum and the lip or cheek.

The oral pouched nicotine product as disclosed herein may have an oblong shape, such as a substantially rectangular shape (as seen from above when the product is placed on a planar surface). In such case, the longitudinal direction of the product corresponds to the length of the substantially rectangular product and the transverse direction of the product corresponds to the width of the substantially rectangular product.

The total weight of the oral pouched nicotine product (including filling material and packaging material) may be within the range of from about 0.3 to about 1.5 g.

The pouch of the oral pouched product may be made of any suitable saliva-permeable (and preferably non-dissolvable) packaging material, such as non-woven. A binder may be included in the packaging material to facilitate sealing of the material by ultrasonic welding.

The packaging material (herein also called pouch material) may be a nonwoven material comprising staple fibres of regenerated cellulose, such as viscose rayon staple fibres, and a binder, such as a polyacrylate.

The packaging material may also comprise additional ingredients, such as flavouring agents and/or colorants.

The oral pouched nicotine product may be packaged in a box, can, canister, cardboard box, bag, stick-pack wrapping, plastic wrapping, paper wrapping, foil wrapping, blister pack or on a tray.

The oral pouched (i.e. portion-packed) nicotine products may be positioned randomly in a container or in a pattern, for instance as described in WO 2012/069505. Alternatively or additionally, each oral pouched nicotine product may be placed in a sachet.

The oral pouched nicotine product as disclosed herein comprises or consists of a moist filling material and a saliva-permeable pouch of a packaging material enclosing the moist filling material. The moist filling material comprises a particulate non-tobacco material, a flavouring agent, a nicotine source, a pH adjusting agent and within the range of from about 0.5 to about 20% by weight, based on total weight of the moist filling material, of a triglyceride. The moist filling material may further comprise a tobacco material as described herein. Alternatively, the moist filling material does not comprise a tobacco material.

Thus, the present disclosure provides an oral pouched nicotine product comprising a moist filling material and a saliva-permeable pouch of a packaging material enclosing the moist filling material, the moist filling material comprising a particulate non-tobacco material; a flavouring agent; a nicotine source; a pH adjusting agent; a tobacco material within the range of from about 0 wt % to about 10 wt %, based on the total weight of the moist filling material, and triglyceride within the range of from about 0.5 wt % to about 20 wt % such as from about 0.5 wt % to about 10 wt % based on the total weight of the moist filling material.

The moist filling material may comprise one, two or more particulate non-tobacco materials.

The moist filling material may comprise one, two or more nicotine sources.

The moist filling material may comprise one, two or more pH adjusting agents.

The moist filling material of the product as disclosed herein may comprise within the range of from about 0.5% to about 20% by weight, such as from about 1 to about 20% by weight or from about 1 to about 10% by weight or from about 1 to about 7% by weight or from about 3 to about 7% by weight, based on total weight of the moist filling material, of a triglyceride.

The moist filling material of the oral pouched nicotine product as disclosed herein may have a moisture content within the range of from about 10 to about 60% by weight, such as from about 20 to about 60% by weight or from about 30 to about 60% by weight or from about 40 to about 60% by weight, from about 40 to about 55% by weight, from about 35 wt % to about 55 wt % or from about 50 wt % to about 60 wt %, based on the total weight of the moist filling material. For instance, the moisture content of the oral pouched nicotine product as disclosed herein may be from about 35 wt % to about 55 wt %, from about 35 wt % to about 45 wt % or from about 50 wt % to about 60 wt %, based on the total weight of the moist filling material.

The moist filling material of the oral pouched nicotine product may be provided as a powder or granulate. Thus, the moist filling material enclosed by the saliva-permeable pouch of the packaging material may be provided in a non-compressed form.

The moist filling material may comprise one or more triglycerides, such as a mixture of two or three triglycerides.

The triglyceride may be selected from the group consisting of a vegetable fat or oil, an animal fat or oil, a synthetic triglyceride, and any combinations thereof.

In particular, the triglyceride may be a vegetable fat and/or oil. A vegetable oil or fat is a triglyceride extracted from a plant. A vegetable oil is liquid at room temperature while a vegetable fat is solid at room temperature.

The triglyceride may be a vegetable fat or oil selected from the group consisting of cocoa butter, coconut oil, palm oil, shea butter, mango kernel oil, corn oil, sunflower oil, soybean oil, rapeseed oil, olive oil, almond oil, jojoba oil, avocado oil, linseed oil, rosehip seed oil, argan oil, sesame oil, macadamia oil, wheat germ oil, broccoli seed oil, grape seed oil, thistle oil, walnut oil, palm kernel oil, cotton seed oil, canola oil, sesame oil, mustard oil, beech nut oil, cashew oil, hazelnut oil, pecan oil, pine nut oil, pistachio oil, grapefruit seed oil, lemon oil, orange oil, pumpkin oil, watermelon seed oil, citrus oils, oils from melons and gourd seeds, flaxseed oil, safflower oil, and any combination of two or more of the foregoing.

The triglyceride may be rapeseed oil, sunflower oil, or coconut oil, or any combination thereof.

The triglyceride may be an animal fat or oil selected from the group consisting of milkfat (also called butterfat), fish oil, lard and tallow.

The triglyceride may be a synthetic triglyceride, such as short-chain triglyceride (SCT) or medium-chain triglyceride (MCT).

The triglyceride, such as a vegetable fat or oil, may be homogeneously distributed in the moist filling material. Thus, the triglyceride and the filling material may be provided as a uniform mixture.

Moreover, the particulate non-tobacco material, the flavouring agent, the nicotine source such as nicotine salt, the pH adjusting agent, the triglyceride, and the tobacco material, if present, may be homogeneously mixed. Thus, the filling material components, i.e. the nicotine source such as nicotine salt, the pH adjusting agent, the triglyceride, and optionally the tobacco, may be homogeneously mixed thereby providing a uniform mixture.

The filling material may comprise within the range of from about 30 to about 80% by weight, based on total weight of the filling material, of the particulate non-tobacco material. For instance, the filling material may comprise within the range of from about 30 wt % to about 50 wt %, based on total weight of the moist filling material, of the particulate non-tobacco material. In a further example, the filling material comprises about 40 wt % based on total weight of the moist filling material, of the particulate non-tobacco material.

The particulate non-tobacco material is preferably water-insoluble.

The particulate non-tobacco material may comprise water-insoluble fibers selected from the group consisting of maize fibers, oat fibers, tomato fibers, barley fibers, rye fibers, sugar beet fibers, buck wheat fibers, wheat fibers, pea fibers, potato fibers, apple fibers, cocoa fibers, bamboo fibers, citrus fibers, and any combinations thereof.

The particulate non-tobacco material may comprise cellulose selected from the group consisting of microcrystalline cellulose and powdered cellulose.

The particulate non-tobacco material may comprise a combination of cellulose, such as microcrystyalline cellulose, and one or more water-insoluble fibers.

In particular, the particulate non-tobacco material may comprise or consist of microcrystalline cellulose.

The filling material may comprise within the range of from about 0.5 wt % to about 15 wt % such as from about 1 wt % to about 10 wt %, based on total weight of the filling material, of the nicotine source.

As used herein, the term "nicotine source" refers to nicotine in any form.

The nicotine source may be nicotine base, a nicotine salt or a nicotine complex, such as nicotine polacrilex.

Nicotine base (oily liquid) may be synthetically produced or extracted from tobacco.

In particular, the nicotine source may be a nicotine salt.

The nicotine source may be a nicotine salt selected from the group consisting of nicotine hydrochloride, nicotine dihydrochloride, nicotine monotartrate, nicotine bitartrate, nicotine bitartrate dihydrate, nicotine sulphate, nicotine zinc chloride monohydrate and nicotine salicylate, and any combinations thereof.

In particular, the filling material may comprise nicotine bitartrate and/or nicotine bitartrate dihydrate.

Additionally or alternatively, the nicotine source may be nicotine bound to an ion-exchange resin. For instance, the nicotine source may be nicotine polacrilex.

The amount of nicotine salt in one pouched product may be within the range from 0.1 mg to 20 mg of nicotine calculated as nicotine base, such as about 0.5, about 1.0, about 1.5, about 2.0, about 2.5, about 3.0, about 3.5, about 4.0, about 4.5, about 5.0, about 6.0, about 7.0, about 8.0, about 9.0, about 10, about 12, about 14, about 16, about 18 or about 20 mg of nicotine.

The nicotine source such as the nicotine salt of the filling material in the oral pouched product as disclosed herein may be in solid form when it is added to form the product during manufacturing Further, the nicotine source such as the nicotine salt of the filling material may be partly or entirely dissolved in the oral pouched nicotine product described herein.

The flavouring agent of the filling material in the oral pouched product as disclosed herein may be a hydrophobic flavouring agent. The flavouring agent may be a liquid, an oil or a combination thereof. The flavouring agent may be encapsulated, non encapsulated or a mixture thereof. The encapsulated flavouring agent and the non-encapsulated flavouring agent may be the same or different. Further, the flavouring agent may be a non-particulate flavouring agent.

The filling material of the oral pouched product as disclosed herein may comprise within the range of from about 0.5 to about 3.0% by weight, based on total weight of the filling material, of the flavouring agent.

Examples of flavors include bergamot, eucalyptus, orange, mandarin, citrus, lemon, peppermint, spearmint, mint, menthol, liquorice, wintergreen, whiskey, rum, cherry, various berries, tobacco, coffee, vanilla, lime, apple, peach and mixtures thereof.

The flavouring agent may be stable at pH>7.

The moist filling material of the oral pouched product as disclosed herein may comprise within the range of from about 1 to about 15% by weight, based on total weight of the filling material, of the pH adjusting agent.

The amount of pH adjusting agent may be selected such that the filling material when dispersed in purified water provides pH above about 7.0, such as pH within the range of from about 7.0 to about 10.0 or pH within the range of from about 8.0 to about 9.0, such as pH within the range of from about 8.3 to about 8.7.

pH of the filling material can be measured by adding 100 ml of distilled water to 5.0 gram of filling material, for instance in a 100 ml Erlenmeyer flask, stirring the resulting mixture at room temperature with a magnetic stirrer at 100 rpm for about 5 minutes, and then measuring the pH of an extract obtained therefrom with a calibrated (according to the manufacturer's instructions) pH meter. For correctness of readings, the sample solutions shall be analyzed within one hour.

Thus, the pH adjusting agent of the moist filling material of the oral pouched product as disclosed herein may provide pH above about 7.0, such as within the range of from about 7.0 to about 10.0 or from about 8.0 to about 9.0 or from about 8.3 to about 8.7, when 5.0 gram of the moist filling material is dispersed in 100 ml purified water. These pH adjusting agents may be used alone or in combination of two or more thereof.

Examples of suitable pH adjusting agents are sodium carbonate, sodium hydroxide, potassium hydroxide, potassium carbonate, sodium carbonate, sodium bicarbonate and magnesium carbonate.

In particular, the pH adjusting agent may be potassium hydroxide.

The filling material of the oral pouched nicotine product as disclosed herein may further comprise a tobacco material, such as within the range of from about 0.1 to about 10% by weight, based on total weight of the filling material. The tobacco material may be a purified tobacco material, such as a bleached tobacco material. Alternatively, the filling material of the oral pouched nicotine product described herein does not comprise a tobacco material. Thus, the filling material of the oral pouched nicotine product described herein may comprise a tobacco material within the range of from about 0 wt % to about 10 wt % such as from about 0.1 wt % to about 5 wt %, based on the total weight of the moist filling material. For instance, the filling material of the oral pouched nicotine product described may comprise no tobacco material or a tobacco material within the range of from about 0.1 wt % to about 10 wt % based on the total weight of the moist filling material.

In particular, the moist filling material described herein may be devoid of surfactants and emulsifiers such as monoglycerides.

It will be appreciated that the moist filling material described herein comprises no added anatabine. However, the moist filling material may comprise anatabine originating from the nicotine source described herein, such as anatabin resulting from decomposition of the nicotine source, or anatabine in the tobacco material.

The filling material of the oral pouched nicotine product as disclosed herein may also comprise a salt selected from the group consisting of sodium chloride, potassium chloride, magnesium chloride, calcium chloride and any combinations thereof.

Sodium chloride is generally used for its effect on taste but it also has a preservative action which contributes to improved shelf life of the product. Salt, such as sodium chloride lowers the water activity of the products, thus preventing microorganisms from growing.

The present disclosure also provides the use of a triglyceride as described herein for flavour preservation, prevention of pouch seal wakening and/or improved shelf life stability in an oral pouched nicotine product as described herein. In particular, the use of triglyceride in an oral pouched nicotine product as described herein reduces or completely eliminates pouch seal weakening for pouch seals involving hydrophobic binders.

Thus, there is provided the use of a triglyceride as described herein for flavour preservation, prevention of pouch seal wakening and/or improved shelf life stability in an oral pouched nicotine product comprising or consisting of a moist filling material and a saliva-permeable pouch of a packaging material enclosing the moist filling material, the moist filling material comprising a particulate non-tobacco material; a flavouring agent; a nicotine source; and a pH adjusting agent.

The filling material of the oral pouched nicotine product as disclosed herein may comprise within the range of from about 1% to about 10% w/w, based on the total weight of the filling material, of sodium chloride, In particular, the oral pouched nicotine product as disclosed herein may be manufactured using a method comprising:

- providing a mixture of a particulate non-tobacco material and a nicotine source, such as a nicotine salt;
- adding triglyceride, such as a vegetable fat or oil, to the mixture of particulate non-tobacco material and nicotine source, thereby providing a mixture of triglyceride, particulate non-tobacco material and nicotine source; and
- adding water to the mixture of triglyceride, particulate non-tobacco material and nicotine source, wherein a pH adjusting agent is added in any of the foregoing step(s) and/or after the addition of water, a flavouring agent is added in any of the foregoing step(s) and/or after the addition of water, and optionally a tobacco material is added in any of the foregoing step(s) and/or after the addition of water.

The method described herein also comprises enclosing the resulting moist filling material in pouches of saliva-permeable packaging material thereby providing the oral pouched nicotine products.

The mixture of particulate non-tobacco material and a nicotine source may be a dry mixture.

The oral pouched nicotine product as disclosed herein may be manufactured using a method comprising:

- providing a mixture of a particulate non-tobacco material and a nicotine source, such as a nicotine salt;
- adding triglyceride, such as a vegetable fat or oil, to the mixture of particulate non-tobacco material and nicotine source, thereby providing a mixture of triglyceride, particulate non-tobacco material and nicotine source;
- adding an aqueous solution of a pH adjusting agent to the mixture of triglyceride, particulate non-tobacco material and nicotine source, thereby providing a moist mixture of triglyceride, particulate non-tobacco material, nicotine source and pH adjusting agent; and
- adding a flavouring agent to the moist mixture of triglyceride, particulate non-tobacco material, nicotine source and pH adjusting agent, thereby providing a moist filling material of triglyceride, particulate non-tobacco material, nicotine source, pH adjusting agent and flavouring agent; and
- enclosing the moist filling material in pouches of saliva-permeable packaging material thereby providing the oral pouched nicotine products.

The invention will now be illustrated by means of the following non-limiting examples.

EXAMPLES

Example 1

TABLE 1

| Ingredient | Amount and percentage based on wet weight of composition | | | |
|---|---|---|---|---|
| | Sample 1 | | Sample 2 | |
| Microcrystalline cellulose (MCC) | 196.65 g | 39% | 196.65 g | 39% |
| Sodium chloride (NaCl) | 17.5 g | 3.5% | 17.5 g | 3.5% |
| Nicotine bitartrate dihydrate | 15.35 g | 3.0% | 15.35 g | 3.0% |
| potassium hydroxide (KOH) | 7.75 g | 1.5% | 7.75 g | 1.5% |
| Water | 257.75 g | 51% | 237.75 g | 47% |
| Rapeseed oil | 5.0 g | 1.0% | 25 g | 5.0% |
| Flavour (containing limonene) | 4.95 g | 1.0% | 4.95 g | 1.0% |

TABLE 2

| Ingredient | Amount and percentage based on wet weight of composition | | | | | |
|---|---|---|---|---|---|---|
| | Sample 3 | | Sample 4 | | Reference | |
| Microcrystalline cellulose (MCC) | 196.65 g | 39% | 196.65 g | 39% | 195.65 g | 39% |
| Sodium chloride (NaCl) | 17.5 g | 3.5% | 17.5 g | 3.5% | 17.5 g | 3.5% |
| Nicotine bitartrate dihydrate | 15.35 g | 3.0% | 15.35 g | 3.0% | 15.35 g | 3.0% |
| potassium hydroxide | 7.75 g | 1.5% | 7.75 g | 1.5% | 7.75 g | 1.5% |
| Water | 257.75 g | 51% | 237.75 g | 47% | 262.75 g | 52% |
| Coconut fat | 5.0 g | 1.0% | 25 g | 5.0% | — | — |
| Flavour (containing limonene) | 4.95 g | 1.0% | 4.95 g | 1.0% | 4.95 g | 1.0% |

In samples 1-4, the dry ingredients MCC, NaCl and nicotine bitartrate were mixed with the fat or oil in a Kenwood mixer (Major Titanium) at minimum speed for 2 minutes.

For samples 1 and 3, 15.5 g of an aqueous 50% w/w KOH solution was added to 250 g (250 ml) water in a container and stirred. The resulting aqueous KOH solution was then added to the dry ingredients during mixing for 5 minutes at speed 1.

For sample 2 and 4, 15.5 g of an aqueous 50% w/w KOH solution was added to 230 g (230 ml) water in a container and stirred. The resulting aqueous KOH solution was then added to the dry ingredients during mixing for 5 minutes at speed 1.

For the reference sample, 15.5 g of an aqueous 50% w/w KOH solution was added to 255 g (255 ml) water in a container and stirred. The resulting aqueous KOH solution was then added to the dry ingredients during mixing for 5 minutes at speed 1.

The flavour was thereafter added to the mixture and the final composition was mixed 4 minutes at minimum speed. The resulting compositions were analyzed with regard to nicotine content (only reference, Sample 3 and Sample 4 were analysed) and flavour content directly after manufacturing and after 1, 2 and 3 weeks of storage at 30° C., 75% relative humidity. Flavor components limonene and linalyl acetate were used as markers for flavor.

Samples were extracted with a liquid-liquid extraction method, which enables simultaneous extraction of both nicotine and flavor compounds. Extracts were analyzed with a GC/MS instrument. Quantification was done using an eight-point standard curve. The method has been verified for different matrices and the recoveries of analytes are better than 95%.

For each replicate 0.5±0.1 g of material was put into an extraction vial. 4 ml of 3 M NaOH was added. The samples were shaken for 5 minutes at ambient temperature (360 rpm). Thereafter 10 ml of methyl tertiary butyl ether and internal standard were added. Samples were shaken for 60 minutes at 50° C. (360 rpm). After cooling for one hour, the organic extracts were transferred to GC-vials and analyzed with GC/MS. Measuring ions for nicotine, limonene and linalyl acetate were 84, 68 and 93 m/z.

Figure 2:
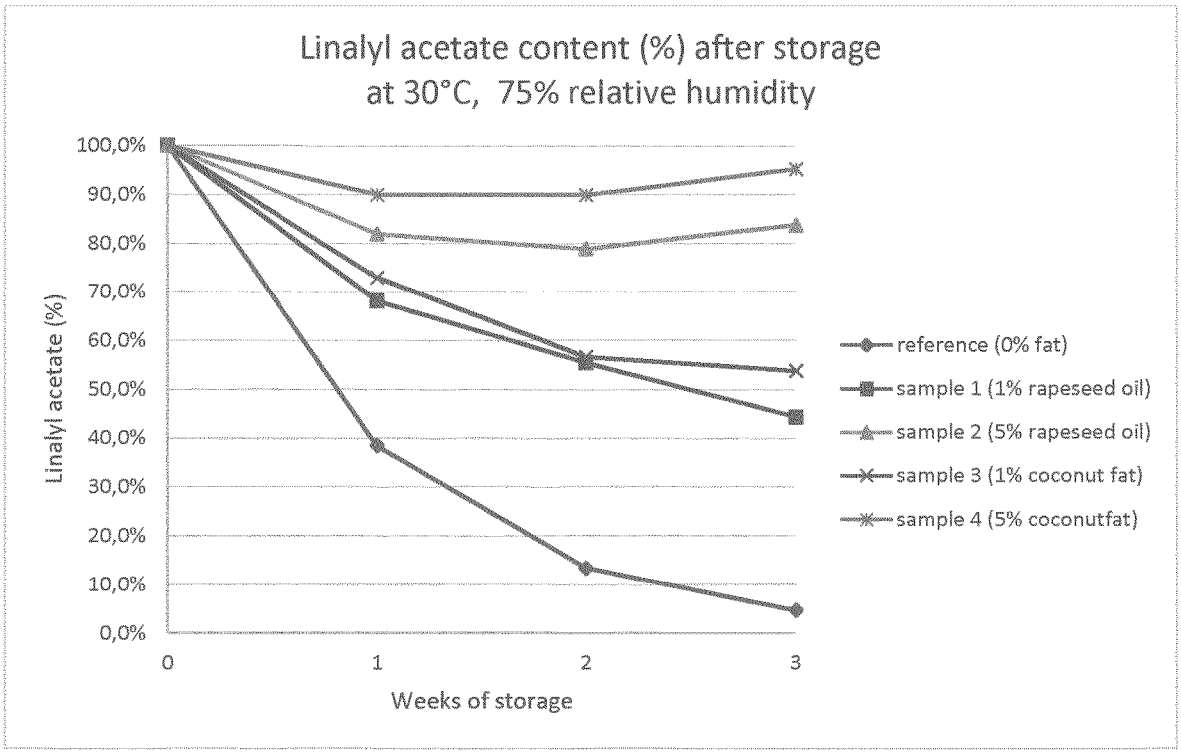
FIG. 2 illustrates linalyl acetate content (%) after storage at 30° C., 75% relative humidity, for a reference (0% fat), sample 1 (1% rapeseed oil), sample 2 (5% rapeseed oil), sample 3 (1% coconut fat), and sample 4 (5% coconut fat).
Figure 3:
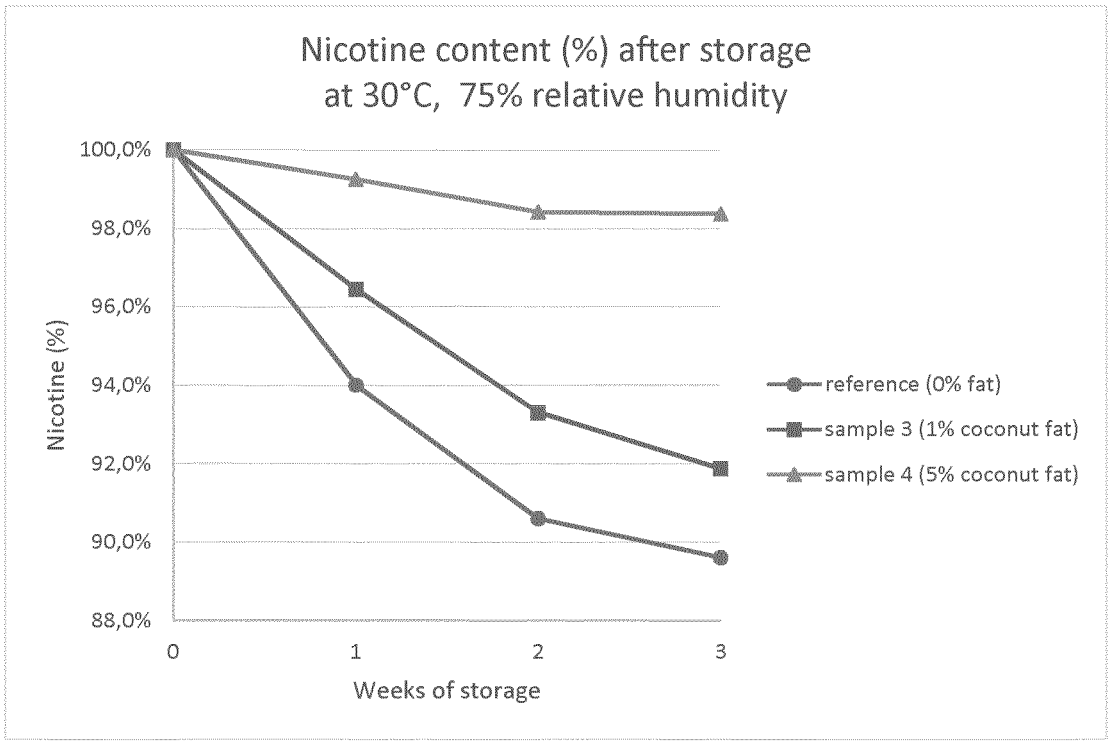
FIG. 3 illustrates nicotine content (%) after storage at 30° C., 75% relative humidity, for a reference (0% fat), sample 3 (1% coconut fat), and sample 4 (5% coconut fat).

The results are presented in Tables 3a-5b below and in FIGS. 1-3. Each measured value is the average value of three analyzed samples.

TABLE 3a

| Storage (weeks) | limonene (mg/g) | | | | |
|---|---|---|---|---|---|
| | 0% fat/oil | 1% coconut fat | 5% coconut fat | 1% rapeseed oil | 5% rapeseed oil |
| 0 | 1.65 | 2.22 | 2.81 | 2.23 | 2.91 |
| 1 | 0.30 | 1.02 | 2.04 | 0.90 | 2.00 |
| 2 | 0.10 | 0.51 | 1.94 | 0.48 | 1.60 |
| 3 | 0.05 | 0.45 | 1.94 | 0.31 | 1.76 |

TABLE 3b

| Storage (weeks) | limonene (%) | | | | |
|---|---|---|---|---|---|
| | 0% fat/oil | 1% coconut fat | 5% coconut fat | 1% rapeseed oil | 5% rapeseed oil |
| 0 | 100% | 100% | 100% | 100% | 100% |
| 1 | 18% | 46% | 73% | 40% | 69% |
| 2 | 6% | 23% | 69% | 22% | 55% |
| 3 | 3% | 20% | 69% | 14% | 61% |

TABLE 4a

| linalyl acetate (mg/g) | | | | | |
|---|---|---|---|---|---|
| Storage (weeks) | 0% fat/ oil | 1% coconut fat | 5% coconut fat | 1% rapeseed oil | 5% rapeseed oil |
| 0 | 3.40 | 3.83 | 4.01 | 3.65 | 4.11 |
| 1 | 1.31 | 2.79 | 3.60 | 2.48 | 3.37 |
| 2 | 0.45 | 2.17 | 3.60 | 2.02 | 3.24 |
| 3 | 0.16 | 2.06 | 3.81 | 1.62 | 3.44 |

TABLE 4b

| linalyl acetate (%) | | | | | |
|---|---|---|---|---|---|
| Storage (weeks) | 0% fat/ oil | 1% coconut fat | 5% coconut fat | 1% rapeseed oil | 5% rapeseed oil |
| 0 | 100% | 100% | 100% | 100% | 100% |
| 1 | 38% | 73% | 90% | 68% | 82% |
| 2 | 13% | 57% | 90% | 55% | 79% |
| 3 | 5% | 54% | 95% | 44% | 84% |

TABLE 5a

| nicotine (mg/g) | | | |
|---|---|---|---|
| Storage (weeks) | 0% fat/ oil | 1% coconut fat | 5% coconut fat |
| 0 | 10.00 | 10.08 | 9.63 |
| 1 | 9.40 | 9.72 | 9.56 |
| 2 | 9.06 | 9.41 | 9.48 |
| 3 | 8.96 | 9.26 | 9.48 |

TABLE 5b

| nicotine (%) | | | |
|---|---|---|---|
| Storage (weeks) | 0% fat | 1% coconut fat | 5% coconut fat |
| 0 | 100% | 100% | 100% |
| 1 | 94% | 96% | 99% |
| 2 | 91% | 93% | 98% |
| 3 | 90% | 92% | 98% |

Example 2

TABLE 6

| | Amount and percentage based on wet weight of composition | | | |
|---|---|---|---|---|
| Ingredient | Sample 5 | | Reference | |
| Microcrystalline cellulose (MCC) | 393.3 g | 39% | 393.3 g | 39% |
| Sodium chloride (NaCl) | 35 g | 3.5% | 35 g | 3.5% |
| Nicotine bitartrate dihydrate | 30.7 g | 3.0% | 30.7 g | 3.0% |
| potassium hydroxide (KOH) | 15.5 g | 1.5% | 15.5 g | 1.5% |
| Water | 425.5 g | 42% | 525.5 g | 52% |
| Rapeseed oil | 100 g | 10.0% | — | — |

TABLE 6-continued

| | Amount and percentage based on wet weight of composition | | | |
|---|---|---|---|---|
| Ingredient | Sample 5 | | Reference | |
| Flavour (containing limonene) | 9.9 g | 1.0% | 9.9 g | 1.0% |

The dry ingredients MCC, NaCl and nicotine bitartrate were mixed with the oil in a Kenwood mixer (Major Titanium) at minimum speed for 2 minutes.

31 g of an aqueous 50% w/w KOH solution was added to 410 g (410 ml) water in a container and stirred. The resulting aqueous KOH solution was then added to the dry ingredients during mixing for 5 minutes at speed 1.

For the reference sample, 31 g of an aqueous 50% w/w KOH solution was added to 510 g (510 ml) water in a container and stirred. The resulting aqueous KOH solution was then added to the dry ingredients during mixing for 5 minutes at speed 1.

The flavour was thereafter added to the mixture and the final composition was mixed 4 minutes at minimum speed.

Each of the Sample 5 composition and the reference composition was thereafter portion-packed in a semi-permeable packaging material of nonwoven using heat-melt welding thereby providing oral pouched products.

The pouched products were also analyzed with regard to pouch seal strength using the following method.

After 10 days storage at room temperature, the samples were prepared by cutting the pouches to a specified width (specified below) and opening the pouch so that one seal is left with two plies. The strength of the seal was then tested using an Instron 5943. One ply is attached to the upper gauge and one ply to the lower gauge. The force used to peel apart the seal was determined and expressed as load per width at maximum load. The following machine parameters were used:

load range: 50 N
extension: 10 mm
gauge length: 13 mm
speed: 10 mm/min
preload: 0.1 N
sample width: 12 mm The results are presented in Table 7 below. Each measured value is the average value of twelve analyzed samples.

TABLE 7

| | Peel strength (N/mm) |
|---|---|
| Sample 5 | 0.077 |
| Reference | 0.053 |

Sample 5 was found to have improved seal strength in comparison to the reference.

Example 3

Figure 4:
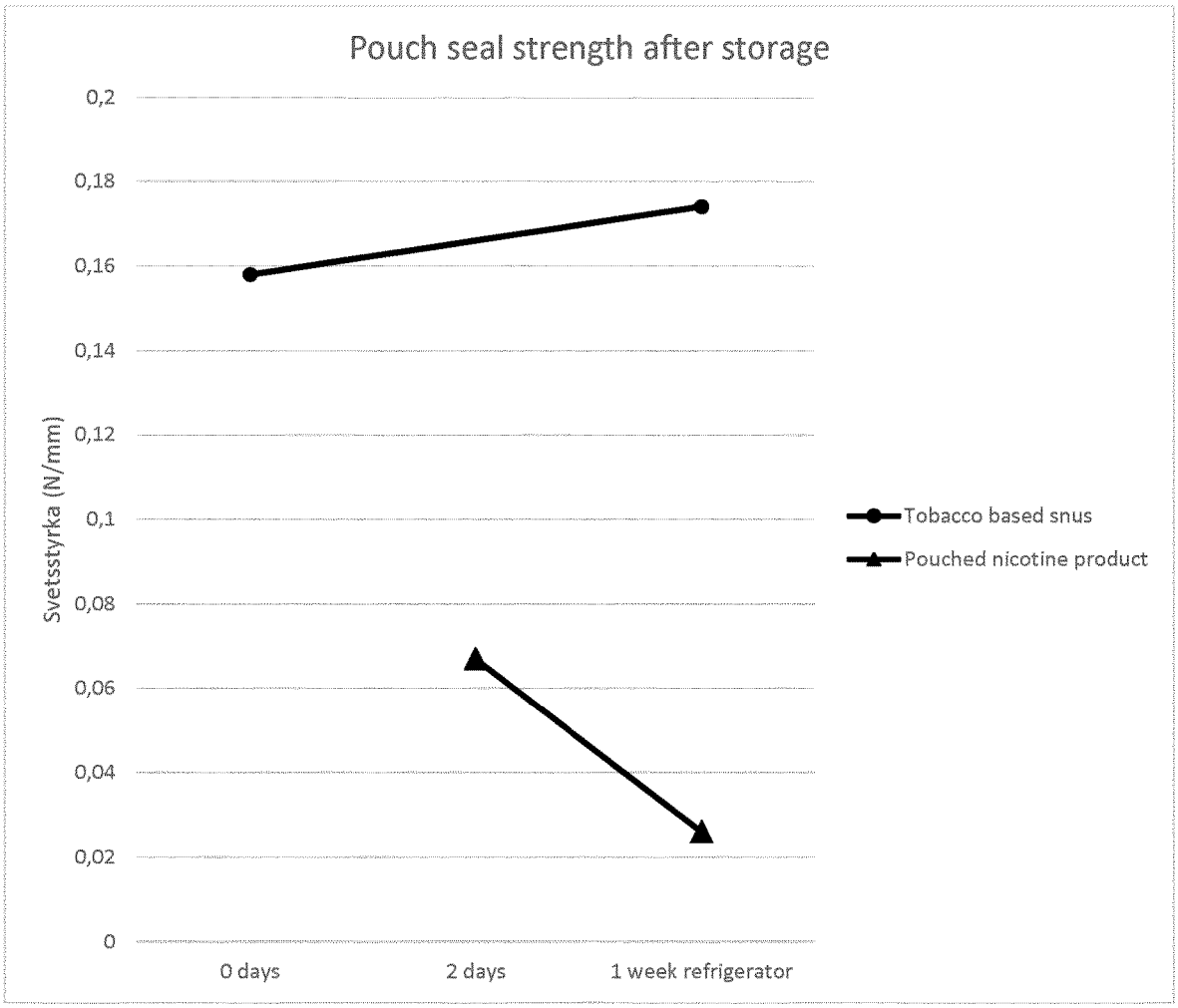
FIG. 4 illustrates a pouch seal strength after storage.

In this experiment, the pouch seal strength was measured for pouched tobacco based snus and a pouched nicotine product, respectively. The tobacco-based snus (moisture content was about 48-51 wt % based on the total weight of the tobacco-based snus) was flavourized with the same peppermint flavour as the pouched nicotine product. The amount of the peppermint flavour was 1.15 wt % based on the total weight of the tobacco based snus and the total weight of the moist filling material, respectively. The pouched nicotine product comprised microcrystalline cellulose and was as described herein but contained no triglyceride (moisture content was about 50 wt % based on the total weight of the nicotine product). They were portion packed in the same processing equipment and with the same non woven material. The pouch seal strength was evaluated using the method described above. The tobacco based snus was analyzed on the same day as the portion packaging and again after 1 weeks of storage in refrigerator. The pouched nicotine product was analyzed after two days and again after 1 weeks of storage in refrigerator. The results are shown in FIG. 4. FIG. 4 clearly shows that the tobacco based snus had no problems with pouch seal weakening. In contrast, the pouch seal strength of the pouched nicotine product was weakened considerably upon storage.

The invention claimed is:

1. An oral pouched nicotine product comprising a moist filling material and a saliva-permeable pouch comprised of a packaging material enclosing the moist filling material, the moist filling material comprising:

a particulate non-tobacco material having an average particle size of from about 50 to 500 μm;

a non-encapsulated flavouring agent;

a nicotine source;

a pH adjusting agent;

microcrystalline cellulose (MCC);

and a triglyceride within the range of from 0.5 wt % to 20 wt %, based on the total weight of the moist filling material, wherein:

the triglyceride and the non-encapsulated flavouring agent are separate components in the moist filling material, the non-encapsulated flavouring agent, the triglyceride, the MCC, the pH adjusting agent, and the nicotine source are in direct contact with one another in the moist filling material, and the non-encapsulated flavouring agent, the triglyceride, the MCC, the pH adjusting agent, and the nicotine source are provided in a uniform mixture in the oral pouched nicotine product; and wherein the moist filling material:

is free from tobacco material, and has a moisture content within the range of from 10 wt % to 60 wt % based on the total weight of the moist filling material.

2. The oral pouched nicotine product according to claim 1, wherein the moist filling material has a moisture content within the range of from 40 wt % to 60 wt %, from 35 wt % to 55 wt %, 35 wt % to 45 wt % or from 50 wt % to 60 wt %, based on the total weight of the moist filling material.

3. The oral pouched nicotine product according to claim 1, wherein the moist filling material comprises triglyceride within a range of from 0.5 wt % to 10 wt % by weight, based on the total weight of the moist filling material.

4. The oral pouched nicotine product according to claim 1, wherein the triglyceride is a vegetable fat or oil selected from the group consisting of: cocoa butter, coconut oil, palm oil, palmolein oil, shea butter, mango kernel oil, corn oil, sunflower oil, soybean oil, rapeseed oil, olive oil, peanut oil, almond oil, jojoba oil, avocado oil, linseed oil, rosehip seed oil, argan oil, sesame oil, macadamia oil, wheat germ oil, broccoli seed oil, grape seed oil, thistle oil, walnut oil, palm kernel oil, cotton seed oil, canola oil, mustard oil, beech nut oil, cashew oil, hazelnut oil, pecan oil, pine nut oil, pistachio oil, grapefruit seed oil, lemon oil, orange oil, pumpkin oil, watermelon seed oil, citrus oils, oils from melons and gourd seeds, flaxseed oil, and safflower oil, or any combination of two or more of the foregoing.

5. The oral pouched nicotine product according to claim 1, wherein the triglyceride is a vegetable fat or oil selected from the group consisting of rapeseed oil, sunflower oil and coconut oil.

6. The oral pouched nicotine product according to claim 1, wherein the triglyceride, the flavouring agent, the nicotine source and the pH adjusting agent are homogeneously distributed in the moist filling material.

7. The oral pouched nicotine product according to claim 1, wherein the particulate non-tobacco material comprises or consists of one or more water-insoluble fibers selected from the group consisting of maize fibers, oat fibers, tomato fibers, barley fibers, rye fibers, sugar beet fibers, buck wheat fibers, wheat fibers, pea fibers, potato fibers, apple fibers, cocoa fibers, bamboo fibers, and citrus fibers, or any combination thereof.

8. The oral pouched nicotine product according to claim 1, wherein the particulate non-tobacco material comprises or consists of powdered cellulose.

9. The oral pouched nicotine product according to claim 1, wherein the moist filling material comprises the nicotine source within the range of from 0.5 wt % to 15 wt % based on total weight of the moist filling material.

10. The oral pouched nicotine product according to claim 1, wherein the nicotine source is:

a nicotine salt selected from the group consisting of nicotine hydrochloride, nicotine dihydrochloride, nicotine monotartrate, nicotine bitartrate, nicotine bitartrate dihydrate, nicotine sulphate, nicotine zinc chloride monohydrate and nicotine salicylate, or any combinations thereof.

11. The oral pouched nicotine product according to claim 1, wherein the nicotine source is a nicotine bound to an ion-exchange resin.

12. The oral pouched nicotine product according to claim 1, wherein the moist filling material is devoid of surfactants and emulsifiers.

13. The oral pouched nicotine product according to claim 1, wherein the particulate non-tobacco material, the flavouring agent, the nicotine source, the pH adjusting agent, and the triglyceride are homogeneously mixed.

14. The oral pouched nicotine product according to claim 1, wherein the pH adjusting agent provides a pH of the moist filling material above 7.0 when the moist filling material is dispersed in purified water.

15. The oral pouched nicotine product according to claim 1, wherein the moist filling material comprises the particulate non-tobacco material within a range of from 30 wt % to 80 wt %, based on total weight of the moist filling material.

16. The oral pouched nicotine product according to claim 9, wherein the moist filling material comprises the nicotine source within the range of from 1.0 wt % to 10 wt % based on total weight of the moist filling material.

17. The oral pouched nicotine product according to claim 1, wherein the nicotine source comprises at least one of a nicotine base, a nicotine salt, and a nicotine complex.

18. A method for manufacturing an oral pouched nicotine product according to claim 1, the method comprising:

providing a mixture of a particulate non-tobacco material and a nicotine source;

adding a triglyceride to the mixture of particulate non-tobacco material and nicotine source, thereby providing a mixture of triglyceride, particulate non-tobacco material and nicotine source; and adding water to the mixture of triglyceride, particulate non-tobacco material and nicotine source, wherein a pH adjusting agent is added in any of the foregoing step(s) and/or after the addition of water, a flavouring agent is added in any of the foregoing step(s).

* * * * *